United States Patent [19]

Papov

[11] Patent Number: 4,782,611

[45] Date of Patent: Nov. 8, 1988

[54] ONE-PIECE FOLDABLE FRAME ASSEMBLY

[76] Inventor: Zelko Papov, 2825 Islington Avenue N, Weston, Canada, M9L 2K1

[21] Appl. No.: 17,722

[22] Filed: Feb. 24, 1987

[30] Foreign Application Priority Data

Feb. 27, 1986 [CA] Canada ..... 502919

[51] Int. Cl.[4] ..... G09F 1/12

[52] U.S. Cl. ..... 40/154

[58] Field of Search ..... 40/154, 155, 152, 158 R; 229/169

[56] References Cited

U.S. PATENT DOCUMENTS

| | | | |
|---|---|---|---|
| 776,311 | 11/1904 | Fisher | 40/154 |
| 849,111 | 4/1907 | Fairchild | 40/154 |
| 905,850 | 12/1908 | Craig | 40/154 |
| 1,323,086 | 11/1919 | Moore | 40/154 |
| 1,450,190 | 4/1923 | Sonn | 40/154 |
| 2,102,519 | 12/1937 | Cross | 40/152 |
| 2,316,615 | 4/1943 | Piper | 40/154 |
| 3,811,214 | 5/1974 | Tate | 40/152 |

FOREIGN PATENT DOCUMENTS

| | | | |
|---|---|---|---|
| 162246 | 5/1948 | Austria | 40/155 |
| 909096 | 4/1946 | France | 40/155 |

*Primary Examiner*—Robert Peshock
*Assistant Examiner*—Cary E. Stone
*Attorney, Agent, or Firm*—Riches, McKenzie & Herbert

[57] ABSTRACT

A one-piece, picture frame and a picture frame assembly are disclosed. The picture frame is made from a suitably-foldable material and has a back piece, edge pieces and front pieces which fold into a back piece, side faces and front faces to frame an object to be framed. An open channel is formed between the respective front faces and the back piece into which the respective edges of the material to be framed can be inserted to position and hold the material to be framed within the picture frame. The picture frame together with the material to be framed form a frame assembly. The front pieces of the picture frame adhere to the top surface of the material to be framed. The invention is useful for framing such items as pictures, photographs and postcards, especially when the object to be framed is sandwiched between a viewing sheet and a backing sheet.

9 Claims, 4 Drawing Sheets

ONE-PIECE FOLDABLE FRAME ASSEMBLY

BACKGROUND OF THE INVENTION

This invention relates to a picture frame and a picture frame assembly, in particular, a one-piece picture frame made from a suitably-foldable material for framing material to be framed wherein the material to be framed comprises at least one flat, planar object.

In the past, there have been many foldable frames made from foldable material. However, many of those frames had pictures pre-printed on the front surface of the back piece of the frame, or had the object to be framed adhered to the front surface of the back piece of the picture frame.

Moreover, the prior art picture frames were either too simple in that they did not provide a suitable frame into which the material to be framed could be inserted. Rather, the material to be framed was merely placed on the frame and attached to the frame. Such frames were not suitable for framing combined material comprising the object to be framed, such as a picture, photograph or postcard, plus a suitable viewing sheet over the object to be framed through which the object to be framed could be viewed, a suitable backing material and perhaps even matting.

On the other hand, other of the prior art picture frames were too complicated to be easily and cheaply manufactured and to be readily used. This is because many of these prior art picture frames utilized a plurality of intricate tabs and tab receiving areas. As a consequence, the picture frame required too many cuts, folds and insertions.

SUMMARY OF THE INVENTION

Accordingly, it is an object of this invention to overcome at least some of the disadvantages of the prior art by providing an inexpensive, easily manufactured and easily-foldable alternative picture frame to the prior art picture frames. Accordingly, in one of its broad aspects, this invention resides in a one-piece, picture frame made from suitably-foldable material, for framing material to be framed which comprises at least one flat, planar object to be framed, comprising: a back piece having a plurality of sides; an edge piece foldably extending from each respective side of the back piece; a front piece foldably extending from each respective edge piece, wherein the shape of each front piece is substantially the same as the shape of the other front pieces; wherein the frame is folded around the material to be framed such that the edge pieces form side faces extending in the same direction and substantially at right angles to the back piece; the front pieces form front faces extending inwardly from the respective side faces; each side edge of each front piece abuts against the adjacent side edge of the adjacent front piece; an open channel is formed between each front face and the back piece; the depth of the channel is substantially the same as the depth of the material to be framed; and the material to be framed is positioned within the frame by positioning a respective outer edge of the material to be framed within the respective channel.

Accordingly, in another of this broad aspects, this invention resides in providing a picture frame assembly comprising a material to be framed, comprising at least one flat, planar object to be framed; suitable viewing sheet over the object to be framed; and suitable backing material under the object to be framed; and a one-piece picture frame made from suitably-foldable material, comprising a back piece having a plurality of sides; an edge piece foldably extending from each respective side of the back piece; a front piece foldably extending from each respective edge piece, wherein the shape of each front piece is substantially the same as the shape of the other front pieces; wherein the frame is folded around the material to be framed such that the edge pieces form side faces extending in the same direction and substantially at right angles to the back piece; the front pieces form front faces extending inwardly from the respective side faces; each side edge of each front piece abuts against the adjacent side edge of the adjacent front piece; an open channel is formed between each front face and the back piece; the depth of the channel is substantially the same as the depth of the material to be framed; and the material to be framed is positioned within the frame by positioning a respective outer edge of the material to be framed within the respective channel.

Accordingly in yet another of its broad aspects, this invention resides in providing a one-piece, picture frame made from suitably-foldable material, for framing material to be framed which comprises at least one flat, planar object to be framed, comprising: a back piece having a plurality of sides; an edge piece foldably extending from each respective side of the back piece; a front piece foldably extending from each respective edge piece, wherein the shape of each front piece is substantially the same as the shape of the other front pieces; wherein the frame is foldable around the material to be framed such that the edge pieces form side faces extending in the same direction and substantially at right angles to the back piece; the front pieces form front faces extending inwardly from the respective side faces; each side edge of each front piece abuts against the adjacent side edge of the adjacent front piece; an open channel is formed between each front face and the back piece; the depth of the channel is substantially the same as the depth of the material to be framed; and the material to be framed is positioned within the frame by positioning a respective outer edge of the material to be framed within the respective channel.

Further aspects of the invention will become apparent upon reading of the following detailed description and the drawings which illustrate the invention and embodiments of the invention.

DETAIL DESCRIPTION OF THE INVENTION AND PREFERRED EMBODIMENTS THEREOF

The picture frame of this invention is a onepiece frame that is made from any suitably-foldable material. Preferred material is corrugated cardboard, cardboard, Bristol board or heavy paper.

The picture frame assembly of this invention comprises the picture frame of the invention in assembly with the material to be framed.

Figure 1:
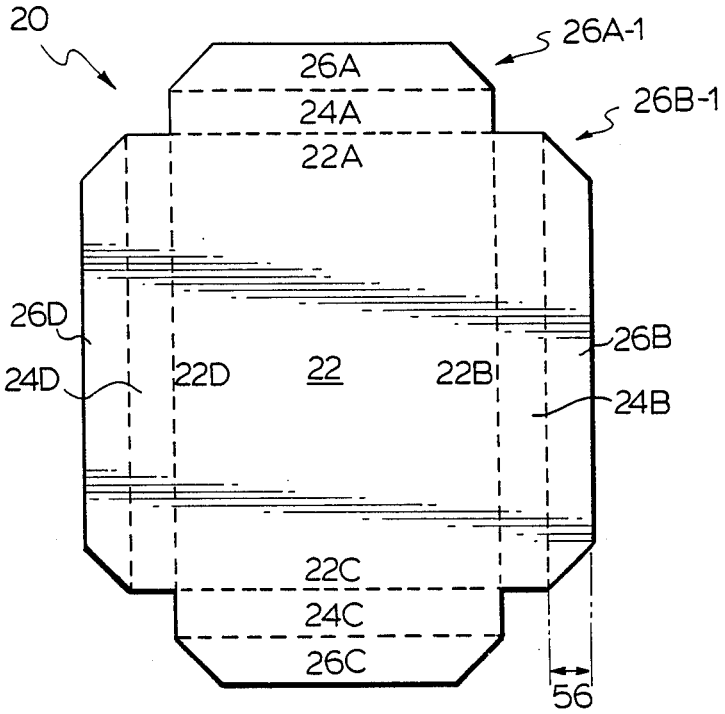
FIG. 1 is a schematic, front view of an embodiment of the picture frame of this invention in its unfolded state.

With reference to FIG. 1, a preferred embodiment of the picture frame 20 can be seen in its preassemblied or pre-folded state. The dimensions illustrated in FIG. 1, and all other figures, are not the actual dimensions but are shown only for the purposes of illustration.

The picture frame 20 comprises a back piece 22 which has a plurality of sides, as required for any particular framing application. Preferred numbers of sides include three, five, six, eight, ten or twelve sides. However, the most preferred number of sides is four as shown in FIG. 1. In FIG. 1, there are sides 22A, 22B, 22C and 22D.

Edge pieces 24A, 24B, 24C and 24D extend from the respective sides of the back piece 22.

Front pieces 26A, 26B, 26C and 26D extend from the respective edge pieces 24.

In order to construct the frame 20, a piece of the suitably-foldable material is cut, either by hand or by any suitable automated means such as a stamp, into the general shape shown in FIG. 1. The cut picture frame 20 is then folded along the dotted lines shown in FIG. 1. Preferably, the frame 20 is scored along the dotted lines before folding.

In order to put the frame 20 into its folded state, the edge pieces 24 are folded upwardly from the back piece 22 at substantially right angles to the back piece 22 to form side faces 24. All side pieces 24 are folded in the same direction.

Figure 2:
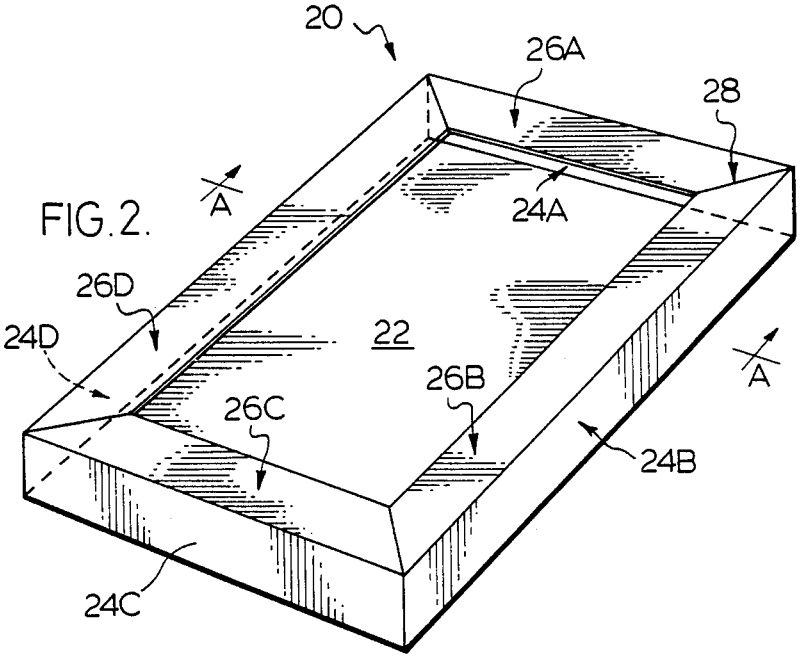
FIG. 2 is a schematic perspective view of an embodiment of the picture of this invention in its folded state.

The front pieces 26 are all folded inwardly from the side faces 24 to form front faces 26 having a frame appearance. The frame appearance is aesthetically pleasing because each side edge (for example 26A-1 in FIG. 2) of each front piece (for example 26A) abuts against the adjacent side edge (26B-1) of the adjacent front piece 26B. Preferably, the abutment is as shown in FIG. 2 at 28, that is, for a four-sided back piece 22, the respective side edges 26A-1 and 26B-1 are cut at a 45° angle.

In order that the side edges 26A-1 and 26B-1 abut in this fashion, it is necessary that the respective front pieces 26A and 26B have similar shapes. Conversely, so long as the side edges of the front faces 26 are abutted rather than overlapped, the provision of similar shapes for the front pieces 26 will permit such an aesthetic appearance.

Figure 3:
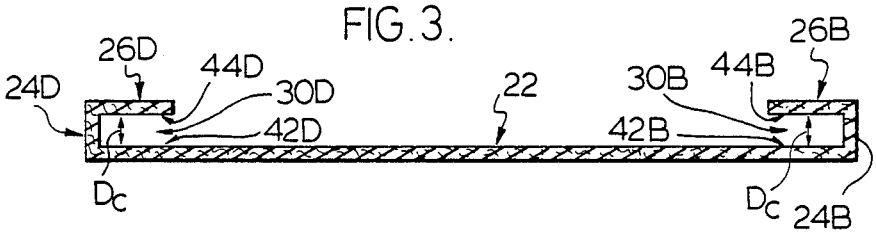
FIG. 3 is a cross-sectional view along the line A—A in FIG. 2.

A particularly important feature of this invention is that open channels 30 are formed between each respective front face 26 and the back piece 22. This is best seen in FIG. 3.

When in use, the channels 30 are used to hold the material to be framed in the proper position within the frame 20. By reference to FIG. 4, it can be seen that the edge 32D of the material to be framed 34 has been inserted within the channel 30D.

Figure 4:
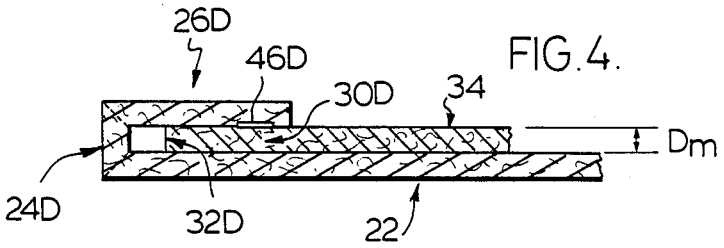
FIG. 4 is a partial cross-sectional view of the picture frame in its folded state and of the picture frame assembly of the invention.

In FIG. 4, the material to be framed 34 is a single, flat, planar object. Usually, the object to be framed would be a picture, photograph, postcard or whatever the user desired.

Figure 5:
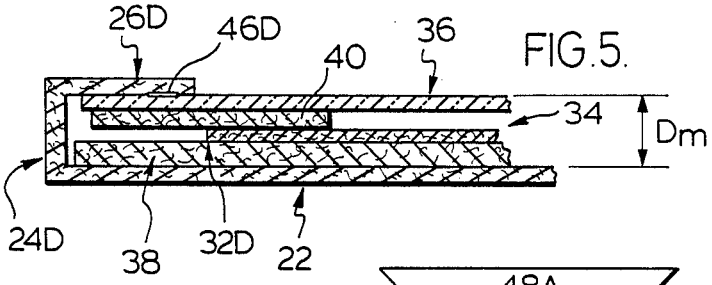
FIG. 5 is a partial cross-sectional view of the picture frame in its folded state and of the picture frame assembly of the invention.

In FIG. 5, the material to be framed comprises the object to be framed (picture, photograph, postcard or similar object) plus a suitable viewing sheet 36, such as a glass or plastic plate, which is placed over the object to be framed 34 so as to allow a viewer to view the object to be framed but at the same time protect the object to be framed from possible damage. Also shown in FIG. 5 is a suitable backing sheet or backing material 38 which can be cardboard, corrugated cardboard, felt or other suitable material.

Also shown in FIG. 5 is a matting 40.

It will noted that the edges of the various object to be framed 34, viewing sheet 36, backing sheet 38 and matting 40 need not, but may, extend all the way into the respective channels 30 so as to abut against the respective edge piece 24. Also, in the embodiment shown in FIG. 5, where there is some material above the object to be framed 34 such as a viewing sheet 36, it is not necessary that the edges 32 of the object to be framed 34 be within the respective channels 30. All that is necessary is that the respective outer edges 32 of the combined material to be framed be within the respective channel 30. The combined material to be framed should be taken to mean the object to be framed by itself or with any of the various materials noted above, namely viewing sheet 36, backing sheet 38 and matting 40. Preferably the backing material 38 should extend into the channels 30 at least as far as any other the other materials so as to provide a suitable support within the channels 30.

The depth of each of the channels 30 should be taken to mean the distance from the top face 42 of the back piece 22 to the lower faces 44 of the front faces 26 (shown as Dc in FIG. 3). Preferably, the depth, Dc, of the channels 30, is substantially the same as the depth of the material to be framed as shown as Dm in FIGS. 4 and 5.

When the depths, Dc, of the channels 30 are substantially the same as the depth of the material to be framed, Dm, the material to be framed can be more readily secured within the frame 20.

Preferably, each of the front faces 26 of the frame 20 is substantially parallel to the back piece 22 when the frame 20 has been folded and is ready for use or is in use.

In order to keep the frame 20 in its folded position (FIG. 2), the material to be framed, whether it is simply the object to be framed 34 or any combination of the object to be framed 34 and a viewing sheet 36, backing sheet 38 and matting 40 is positioned within the frame 20 and the frame 20 is appropriately folded around the material to be framed. The under or lower face 44 of the front pieces 26 are then adhered to the top face of the material to be framed as generally shown at 46D on FIGS. 4 and 5. The front pieces 26 can be adhered by any suitable means, for example, sticky tape, glue or adhesive. The suitable means 46 can be pre-applied to the front pieces 26 before use by the person who uses the frame 20 as a frame, or the suitable means 46 can be applied during the framing operation itself.

Figure 6:
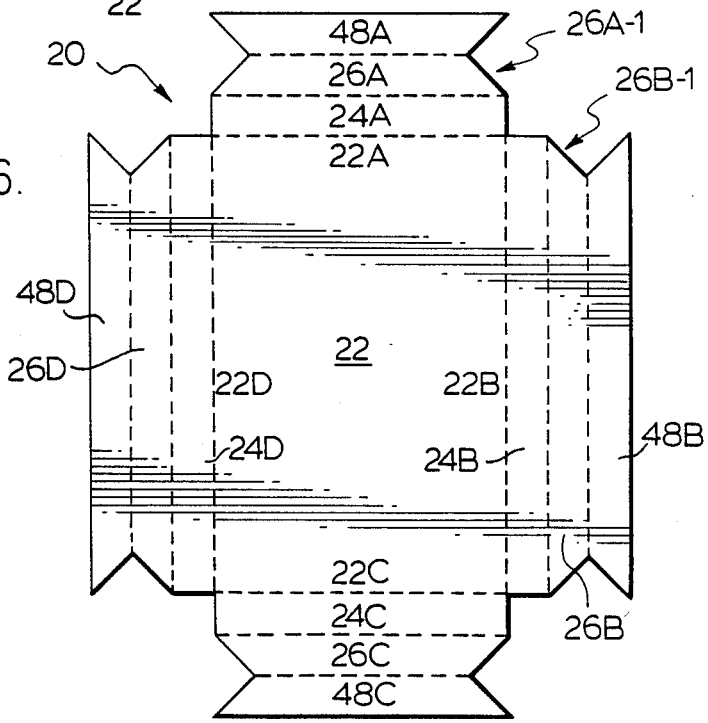
FIG. 6 is schematic, front view of a further embodiment of the picture frame of this invention in its unfolded state.

In a preferred embodiment, there is an under piece 48 extending from each respective front piece 26 as shown in FIG. 6. The respective under piece 48 is folded under the respective front piece 26. This provides a folded edge to be exposed for view in the front area of the frame 20 rather than simply a cut edge.

The under pieces 48 also provide an additional material to absorb shock if the frame 20 is accidentally dropped with the material to be framed already placed within the frame 20.

If the frame 20 has under pieces 48, the channels 30 are created between the under pieces 48 and the back piece 22. Accordingly, the depth, Dc, of the channels 30 should be measured from the lower face of the respective under pieces 48 to the top face 42 of the back piece 22.

Also, in such an embodiment, the under or lower face of each respective under piece 48 is adhered to the top face of the material to be framed, as described above.

Figure 7:
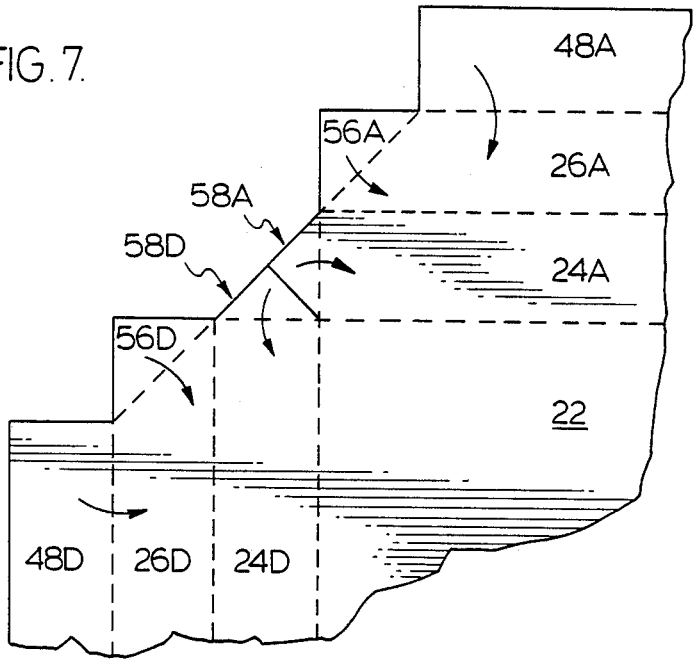
FIG. 7 is a partial schematic, front view of a further embodiment of the invention.

In a further embodiment as shown in FIG. 7, as well as under pieces 48 extending from the front edges of the front pieces 26, there are under pieces 56 extending from the side edges 26-1 of the front pieces 26. Under pieces 56 can be folded under the respective front pieces 26 as indicated by the arrows in FIG. 7 to provide a folded edge appearance to be exposed to view at the joints of the front pieces 26.

Also, under pieces 58 can be extended from the side edges of side pieces 24 to provide a folded edge appearance exposed to view at the joints of the side pieces 24.

Figure 8:
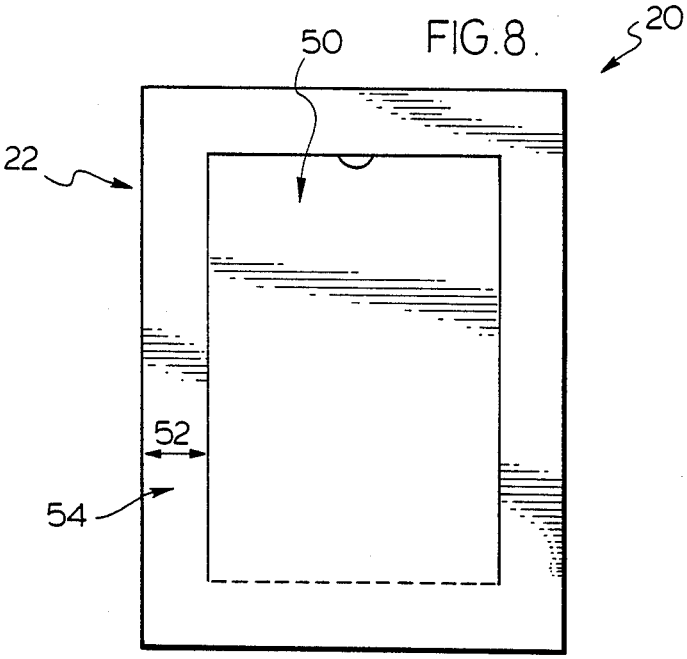
FIG. 8 is a schematic back view of an embodiment of the picture frame of this invention in its folded state.

In a further embodiment, the back piece 22 is cut so as to form a flap 50 as shown in FIG. 8. Flap 50 can be opened by turning it back so as to permit insertion and withdrawal of the object to be framed 34 within the picture frame 20. In order to permit easy insertion and withdrawal of the object to be framed 34, the width 52 of the border 54 between the flap 50 and the side edges of the back piece 22 should be equal to or less than the width 56 of the front faces 26 (shown in FIG. 1).

Figure 9:
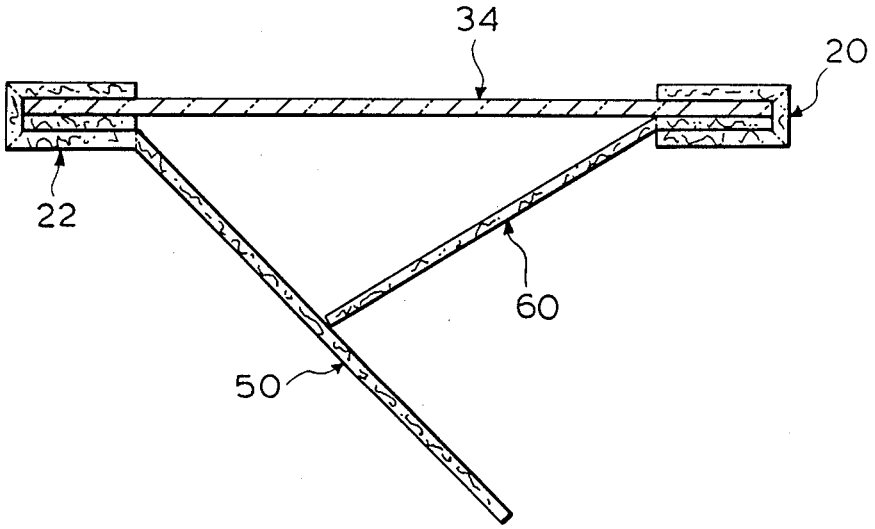
FIG. 9 is a cross-sectional view of the picture frames in its folded state.

If the material to be framed includes, backing material 38, there should also be a flap 60 (FIG. 9) in the backing material 38 that is similar to flap 50. Preferably, the flap 60 in the backing material 38 and the flap 50 in the back piece 22 should open from different directions, whether or not they are opposed directions, in order that the flap 50 will assist in keeping the flap 60 in the backing material 38 closed.

In order to obtain a particularly pleasing finished frame 20, it is possible to wrap the frame 20 with decorative paper so that the exposed faces of the frame 20 have a pleasing appearance.

Also, the paper can be wrapped around all of the edges, in particular, the side edges 26-1 of the front faces 26. This ensures that the abutment of the faces 26 will take on a pleasing appearance between there will be no cut edges exposed to view by the viewer.

The invention is particularly useful when it is used in combination with an object to be framed 34, a suitable viewing sheet 36 and a suitable backing sheet 38.

Although the disclosure describes and illustrates preferred embodiments of the invention, it is to be understood that the invention is not restricted to these particular embodiments.

What I claim is:

1. A one-piece, picture frame made from suitably-foldable material, for framing material to be framed which comprises at least one flat, planar object to be framed and a suitable backing material under the object to be framed, comprising:

a back piece having a plurality of sides;

an edge piece foldably extending from each respective side of the back piece;

a front piece foldably extending from each respective edge piece, wherein the shape of each front piece is substantially the same as the shape of the other front pieces, and has a front edge and side edges;

wherein the front is folded around the material to be framed such that:

the edge pieces form side faces extending in the same direction and substantially at right angles to the back piece;

the front pieces form front faces extending inwardly from the respective side faces;

each side edge of each front piece abuts against the adjacent side edge of the adjacent front pieces;

an open channel is formed between each front face and the back piece;

the depth of the channel is substantially the same as the depth of the material to be framed; and the material to be framed is positioned within the frame by positioning a respective outer edge of the material to be framed within the respective channel;

wherein each front face is adhered to the top face of the material to be framed;

wherein the back piece is cut so as to form a flap which permits insertion and withdrawal of the object to be framed; and wherein the suitable backing material is cut so as to form a flap which permits a insertion and withdrawal of the object to be framed.

2. A picture frame as defined in claim 1 wherein the flap in the back piece opens in a different direction than does the flap in the backing material.

3. A picture frame as claimed in any of claims 1 or 2 wherein each of the front pieces lies in a plane substantially parallel to the back piece.

4. A picture frame assembly comprising:

(a) material to be framed, comprising at least one flat, planar object to be framed;

suitable viewing sheet over the object to be framed; and (b) a one-piece picture frame made from suitably foldable material, comprising:

a back piece having a plurality of sides;

an edge piece foldably extending from each respective side of the back piece;

a front piece foldably extending from each respective edge piece, wherein the shape of each front piece is substantially the same as the shape of the other front pieces, and has a front edge and side edges;

wherein the frame is folded around the material to be framed such that:

the edge pieces form side faces extending in the same direction and substantially at right angles to the back piece;

the front pieces form front faces extending inwardly from the respective side faces;

each side edge of each front piece abuts against the adjacent side edge of the adjacent front piece;

an open channel is formed between each front face and the back piece;

the depth of the channel is substantially the same as the depth of the material to be framed; and the material to be framed is positioned within the frame by positioning a respective outer edge of the material to be framed within the respective channel;

wherein each front face is adhered to the top face of the material to be framed;

wherein the back piece is cut so as to form a flap which permits insertion and withdrawal of the object to be framed; and wherein the suitable backing material is cut so as to form a flap which permits insertion and withdrawal of the object to be framed.

5. A picture frame assembly as defined in claim 4 wherein the flap in the back piece opens in a different direction than does the flap in the backing material.

6. A picture frame assembly as claimed in any of claims 4 or 5 wherein each of the front pieces lies in a plane substantially parallel to the back piece.

7. A one-piece, picture frame made from suitably-foldable material, for framing material to be framed which comprises at least one flat, planar object to be framed, a suitable viewing sheet over the object to be framed and a suitable backing material under the object to be framed, comprising:

a back piece having a plurality of sides;

an edge piece foldably extending from each respective side of the back piece;

a front piece foldably extending from each respective edge piece, wherein the shape of each front piece is substantially the same as the shape of the other front pieces, and has a front edge and side edges;

wherein the frame is foldable around the material to be framed such that:

the edge pieces form side faces extending in the same direction and substantially at right angles to the back piece;

the front pieces form front faces extending inwardly from the respective side faces;

each side edge of each front piece abuts against the adjacent side edge of the adjacent front piece;

an open channel is formed between each front face and the back piece;

the depth of the channel is substantially the same as the depth of the material to be framed; and the material to be framed is positioned within the frame by positioning a respective outer edge of the material to be framed within the respective channel;

wherein the back piece is cut so as to form a flap which permits insertion and withdrawal of the object to be framed; and wherein the suitable backing material is cut so as to form a flap which permits insertion and withdrawal of the object to be framed.

8. A picture frame as defined in claim 7 wherein the flap in the back piece opens in a different direction than does the flap in the backing material.

9. A picture frame as claimed in any of claims 7 or 8 wherein each of the front pieces lies in a plane substantially parallel to the back piece.

* * * * *